US005853560A

United States Patent [19]

Sharma

[11] Patent Number: 5,853,560

[45] Date of Patent: Dec. 29, 1998

[54] ELECTROLYTIC MAGNESIUM PRODUCTION PROCESS USING MIXED CHLORIDE-FLUORIDE ELECTROLYTES

[75] Inventor: Ram A. Sharma, Troy, Mich.

[73] Assignee: General Motors Corporation, Detroit, Mich.

[21] Appl. No.: 801,888

[22] Filed: Feb. 18, 1997

Related U.S. Application Data

[60] Provisional application No. 60/020,376 Jun. 25, 1996.

[51] Int. Cl. [6] ..... C25C 3/04

[52] U.S. Cl. ..... 205/405; 205/407; 205/411; 205/408

[58] Field of Search ..... 205/404–405, 205/407, 409, 408, 411

[56] References Cited

U.S. PATENT DOCUMENTS

| | | | |
|---|---|---|---|
| 2,880,151 | 3/1959 | Dean et al. | 205/405 |
| 2,950,236 | 8/1960 | Dean et al. | 205/401 |
| 4,073,704 | 2/1978 | Beale, Jr. | 205/405 |
| 5,089,094 | 2/1992 | Ogasawara et al. | 205/405 |
| 5,279,716 | 1/1994 | Sharma | 205/404 |
| 5,378,325 | 1/1995 | Dastolfo, Jr. et al. | 205/405 X |
| 5,427,657 | 6/1995 | Sharma | 205/560 |
| 5,565,080 | 10/1996 | Peacey et al. | 205/404 X |

OTHER PUBLICATIONS

Zhuxian et al, "Preparation of Aluminum–Magnesium Master Alloys by Electrolysis of Magnesium Oxide in Fluoride Melts," *Light Metals 1991*, The Minerals, Metals & Materials Society, 1990, pp. 349–355 (No Month).

Abstract of JP 54040210A published Mar. 29, 1979, *WPI Database,* Section Ch, Week 7918, Derwent Publications Ltd., London, Class M28, AN 79–34540B.

*Primary Examiner*—Donald R. Valentine
*Attorney, Agent, or Firm*—George A. Grove

[57] ABSTRACT

A method is disclosed for the production of magnesium in which a magnesium chloride (which may be partially dehydrated) and/or magnesium oxide-containing feedstock is reacted with an electrolyte consisting essentially of magnesium cations, lithium and/or calcium cations, and fluoride and chloride anions, whereby the magnesium chloride and/or magnesium oxide react with and dissolve in the electrolyte, and lithium or calcium initially is produced electrochemically and transiently at the cathode and reacts chemically with magnesium cations in the electrolyte to produce magnesium metal. Thus, the method essentially involves a first electrochemical step to produce lithium or calcium metal and a subsequent second chemical step in which lithium or calcium reacts with magnesium fluoride in the electrolyte to produce magnesium metal.

4 Claims, No Drawings

ELECTROLYTIC MAGNESIUM PRODUCTION PROCESS USING MIXED CHLORIDE-FLUORIDE ELECTROLYTES

This application claims the priority of provisional application Serial No. 60/020,376 filed Jun. 25, 1996.

This invention relates to electrolytic processes for producing magnesium and to electrolytes for use in the processes that permit use of inexpensive magnesium chloride feed with magnesium oxide impurity.

BACKGROUND OF THE INVENTION

Most magnesium is produced by fused chloride salt electrolysis. In this process, a melt consisting of magnesium chloride ($MgCl_2$), calcium chloride ($CaCl_2$), and sodium chloride (NaCl) is used as an electrolyte. Magnesium chloride is electrolytically decomposed to produce magnesium metal (Mg) on a steel cathode and chlorine gas ($Cl_2$) on a graphite anode at temperatures between 700° C. and 740° C. The process differs from plant to plant mainly in the type of $MgCl_2$ feedstock used or the techniques used in preparing the $MgCl_2$ feedstock. The reason for this is that magnesium oxide in the electrolyte creates problems in the cell operation and leads to its malfunctioning. Therefore, attempts have mostly been made to improve magnesium chloride feed and its preparation techniques. Fifty percent of the cost and energy consumption for the production of magnesium is reported to come from the preparation of magnesium chloride.

There are two kinds of conventional electrolytic magnesium production processes. In one, practiced by Dow Chemical Co., partially dehydrated magnesium chloride feed is used. In the second, practiced by others such as Norsk Hydro, anhydrous $MgCl_2$ feed is used. In the Dow process, the formation of magnesium oxide naturally occurs to the detriment of the efficiency and longevity of cell operation. In the Norsk Hydro process, the cost of preparing anhydrous magnesium chloride adds significantly to the cost of producing magnesium.

Recently, practices have been devised which will accommodate magnesium oxide as a feedstock or as a constituent of a magnesium chloride feedstock for the electrolytic production of magnesium. For example, U.S. Pat. Nos. 5,279,716 and 5,427,657, both issued to Ram A. Sharma and assigned to the assignee of the subject application, disclose the use of rare earth chloride and rare earth fluoride, respectively, in suitable electrolyte mixtures to dissolve magnesium oxide. However, for some purposes it is desirable to have a magnesium production process employing an electrolyte that does not require the use of rare earth element constituents.

Accordingly, it is an object of this invention to provide a method and electrolyte for the production of magnesium that utilizes inexpensive salts and readily accommodates significant amounts of magnesium oxide in the feedstock.

SUMMARY OF THE INVENTION

This invention employs a range of electrolyte compositions to produce low-cost magnesium by permitting the use of inexpensive magnesium chloride having magnesium oxide impurity as the feedstock. The electrolytes consist of a suitable combination of fluorides and chlorides: fluorides to dissolve magnesium chloride feed and its magnesium oxide impurity, and to cleanse the magnesium produced to the maximum possible extent; and chlorides for electrolysis to produce a metal (e.g., lithium or calcium) that instantly reacts with the electrolyte to produce magnesium. The process produces magnesium by chemically reacting the electrolytically-produced metal with magnesium fluoride in the electrolyte. The fluorides are lithium fluoride (LiF), magnesium fluoride ($MgF_2$), and calcium fluoride ($CaF_2$). The chlorides are lithium chloride (LiCl) and calcium chloride ($CaCl_2$). A range of electrolytes are suitable, from compositions which are mostly fluorides with a small amount of a chloride, to those which are mostly chlorides with a small amount of fluorides. This means there is a great flexibility in selecting the electrolyte composition suitable to dissolve magnesium oxide and still not attack the alumina refractory components of the cell. These electrolytes can be used in the conventional magnesium production cell. Also, electrolyte compositions can be formulated that are of suitable density to use in a cell to produce magnesium at the bottom of the electrolyte, as in an aluminum-type cell.

Thus, electrolytic processes are provided to produce low-cost magnesium which uses a family of mixed fluoride-chloride electrolytes having the capability to dissolve an appreciable amount of MgO contained in an inexpensive magnesium chloride feed. Depending upon the cation content of the electrolyte, calcium or lithium metal (for example) is produced which reacts immediately with magnesium fluoride to produce magnesium metal and regenerate lithium or calcium cations.

Other objects and advantages of this invention will become more apparent from a detailed description thereof which follows.

DESCRIPTION OF PREFERRED EMBODIMENTS

The present invention may be practiced in accordance with the following embodiments to provide the following results and benefits.

In one version, an electrolyte is selected so that the process parallels the Dow or Norsk Hydro processes in that the magnesium is produced and recovered in a cathode zone at the upper surface of the electrolyte. This practice enables the use of existing magnesium production equipment with an inexpensive magnesium chloride feed containing magnesium oxide.

In one embodiment, a relatively low density electrolyte is composed such that the process will produce magnesium at the bottom of the electrolyte, as in aluminum production. This embodiment minimizes exposure of molten magnesium to chlorine gas without requiring the complex cathode chambers of the present production processes.

In any embodiment, the invention permits use of a magnesium chloride feed which is dehydrated by simply heating in air. Using such a feed definitely lowers the cost of magnesium production, as 50% of the cost and energy of magnesium production is involved in the preparation of the magnesium chloride feed.

In another embodiment, the process may be adapted to use MgO in place of magnesium chloride as feed material. The use of MgO as feed simplifies the whole production process, especially as regards feedstock preparation.

This invention then provides an electrolytic process in which inexpensive $MgCl_2$ containing an appreciable amount of MgO is used as a feedstock. In another embodiment, MgO may essentially constitute the feedstock. For the electrolytic decomposition of $MgCl_2$ and MgO, it is essential to dissolve both in an electrolyte and then to decompose them electrolytically without decomposing any other component of the electrolyte. In accordance with the invention, this is accomplished by using electrolyte melts consisting of fluorides and chlorides: fluorides to dissolve $MgCl_2$ feed and its MgO content and to cleanse the produced Mg to the maximum possible extent; and chlorides for electrolyzing to produce a metal which will produce magnesium by chemically reacting with magnesium fluoride in the electrolyte.

Electrolytes for Conventional Cells

The published $MgF_2$—$CaF_2$—LiF ternary phase diagram indicates a ternary eutectic of 27.9 mole % $MgF_2$, 13.1 mole % $CaF_2$, and 59.0 mole % LiF at 672° C. and a large surrounding compositional region of melts below 750° C. This means a substantial composition range of these melts is available for use in the electrolytes to permit cell operation in this temperature region.

In the following description of the chemical interactions in the electrolyte in an operating cell it is, of course, recognized that all of the chemical species are present substantially as free anions and cations. However, for purposes of description, it is useful and instructive to refer to compounds because of the availability of published phase diagrams and thermochemical data. The subject processes appear to function in accordance with the following equations.

The standard free energy changes of the reactions of $MgCl_2$ with $CaF_2$ and LiF can be calculated using the standard free energies of formation of the respective compounds. Both reactions have negative standard free energy changes and therefore they are spontaneous, but the reaction with LiF has a standard free energy change more negative than the reaction with $CaF_2$. Therefore, on addition of a $MgCl_2$-containing feedstock to the ternary fluoride melt, the reaction with LiF predominates, forming LiCl and $MgF_2$:

$$MgCl_2+2LiF \rightarrow MgF_2+2LiCl \quad (1)$$

Now the melt consists of the fluorides plus LiCl. The presence of the LiCl does not require a substantial increase in cell operating temperature. Actually, the eutectic temperature of this quaternary mixture may be slightly lower than the ternary fluoride eutectic. This decrease is indicated by the published LiF—LiCl phase diagram where the addition of LiCl lowers the melting point of LiF. The phase diagrams of the $MgCl_2$—$MgF_2$ and $CaF_2$—$CaCl_2$ systems also show similar behavior.

On imposition of a potential to carry out the electrolysis, LiCl is decomposed electrolytically by the reaction $$2LiCl \rightarrow 2Li+Cl_2 \quad (2)$$

as is indicated by its calculated decomposition potential being lower than that of any other component of the electrolyte.

In actual cell operation, when $MgCl_2$ containing feed is added to the $MgF_2$—$CaF_2$—LiF eutectic melt electrolyte, reaction (1) takes place, forming magnesium fluoride plus LiCl in the melt. This melt composition consisting of LiCl, LiF, $MgF_2$, and $CaF_2$ can also be prepared by using calculated amounts of these compounds. For example, if the $MgF_2$—$CaF_2$—LiF eutectic is desired as the electrolyte composition, then this composition with a certain amount of LiCl—LiF eutectic melt (about 10 w/o) can be used. The electrolyte consisting of these two melts should also be a pure melt. The LiF content from the LiCl—LiF eutectic can react with $MgCl_2$ feed, leaving the $MgF_2$—$CaF_2$—LiF eutectic composition of the electrolyte intact. Electrolysis to produce lithium and chlorine and adding of $MgCl_2$ are necessary to start simultaneously to maintain this condition.

Another alternative to achieve the above objective is to have a suitable amount of LiCl (about 10 w/o) and the ternary $MgF_2$—$CaF_2$—LiF eutectic melt in the electrolyte. Electrolysis to produce lithium and chlorine, and adding of $MgCl_2$-containing feedstock should again start simultaneously. In this way, the electrolyte composition may be maintained constant.

The lithium electrolytically produced by reaction (2) will react with $MgF_2$ in the electrolyte melt producing Mg by the reaction $$2Li+MgF_2 \rightarrow 2LiF+Mg \quad (3)$$

The spontaneity of this reaction is indicated by its calculated negative standard free energy change. The net result of reactions (1)–(3) is the reaction $$MgCl_2 \rightarrow Mg+Cl_2 \quad (4)$$

whose standard decomposition potential as a function of temperature is known. During electrolysis, $MgCl_2$ decomposes without decomposing any of the other compounds in the electrolyte melt.

The phase diagram of $MgF_2$—MgO shows that about 10 mole % MgO is soluble in $MgF_2$ at 1210° C. and that of $CaF_2$—MgO shows that about 18 mole % MgO is soluble in $CaF_2$ at 1350° C. Magnesium oxide should also be appreciably soluble in a LiF melt as the cationic radii of $Li^+$ (0.68 Å) and $Mg^{2+}$ (0.66 Å), and the anionic radii of $F^-$ (1.33 Å) and $O^{2-}$ (1.32 Å) are not much different. The solubility of MgO in LiF has been measured to be approximately 5 mole % at 830° C. The above data indicate that MgO should be appreciably soluble in the ternary $MgF_2$—$CaF_2$—LiF eutectic melt electrolyte.

Utilization of MgO in Feedstock

In this situation, any magnesium oxide impurity in the magnesium chloride feed dissolves in the fluoride-based electrolyte and also decomposes electrolytically along with magnesium chloride in the presence of a carbon anode by the reaction $$MgO+\tfrac{1}{2}\,C \rightarrow Mg+\tfrac{1}{2}\,CO_2 \quad (5)$$

This is indicated by its standard decomposition potential. Any oxide initially present in the electrolyte components ($Li_2O$ or CaO) will be converted to MgO upon melting of the electrolyte. This is indicated by the negative standard free energy change of the reactions of these oxides with magnesium fluoride.

Magnesium oxide is also consumed by its chemical reaction with LiF in the electrolyte and the electrolytically generated chlorine:

$$MgO+2LiF+Cl_2 \rightarrow MgF_2+2LiCl+\tfrac{1}{2}\,O_2 \quad (6)$$

This is indicated by the negative standard free energy change of this reaction. Therefore, an inexpensive $MgCl_2$ containing MgO may be used as feed.

So far, the melts having a certain amount of LiCl and the rest LiF, $MgF_2$, and $CaF_2$ have been described. These melts are able to take care of the problems associated with a MgO impurity in the $MgCl_2$ feed. However, they may be found to be slightly more costly and too corrosive for the conventionally used alumina refractory components of the electrolytic cell because of the presence of LiCl and LiF.

The ternary $CaCl_2$—$CaF_2$—$MgF_2$ and $CaCl_2$—$MgCl_2$—$MgF_2$ sections of the quaternary $CaCl_2$—$CaF_2$—$MgCl_2$—$MgF_2$ phase diagram show their respective eutectics at 644°

C. and 561° C. and a wide range of melts below 700° C. All these melts are suitable for use as electrolytes. For example, a melt consisting of suitable amounts of only $CaCl_2$, $CaF_2$, and $MgF_2$ without $MgCl_2$ to eliminate its problems can be chosen as an electrolyte from the $CaCl_2$—$CaF_2$—$MgF_2$ ternary section. In this case the reactions analogous to those in the case of the LiF—$MgF_2$—$CaF_2$ electrolyte are as follows. On the addition of $MgCl_2$ feed in the cell, the reaction $$MgCl_2+CaF_2 \rightarrow MgF_2+CaCl_2 \quad (7)$$

should occur as is indicated by its negative standard free energy change. On imposition of a potential to carry out the electrolysis, $CaCl_2$ will decompose electrolytically by the reaction $$CaCl_2 \rightarrow Ca+Cl_2 \quad (8)$$

This is indicated by its standard decomposition potential lower than that of any other component of the electrolyte. The electrolytically produced calcium will react with $MgF_2$ in the electrolyte melt producing magnesium by the reaction $$Ca+MgF_2 \rightarrow Mg+CaF_2 \quad (9)$$

This reaction is indicated by its negative standard free energy change. The net result of reactions (7)–(9) is again the electrolytic magnesium chloride decomposition reaction (4) described before. Magnesium oxide should also dissolve in this electrolyte consisting of chloride and fluorides and be electrolytically consumed by reaction (5) mentioned before. Magnesium oxide will also be consumed by its chemical reaction with $CaF_2$ in the electrolyte and the electrolytically generated chlorine:

$$MgO+CaF_2+Cl_2 \rightarrow MgF_2+CaCl_2+\tfrac{1}{2}\,O_2 \quad (10)$$

This is indicated by the negative standard free energy change of this reaction.

If $MgCl_2$ presence in the electrolyte is required for any cell operational reason, then a melt consisting of suitable amounts of only $CaCl_2$, $MgCl_2$, and $MgF_2$ can be chosen as an electrolyte from the $CaCl_2$—$MgCl_2$—$MgF_2$ ternary section. The quaternary system provides great flexibility for choosing the melts which may be found suitable to take care of the problems associated with MgO in the $MgCl_2$ feed and still not be too corrosive for the alumina refractory components. These melts are inexpensive compared to other fluorides and chlorides.

The phase diagram of the quaternary LiF—LiCl—$MgF_2$—$MgCl_2$ system contains two ternary LiF—LiCl—$MgF_2$ and LiCl—$MgF_2$—$MgCl_2$ sections. The diagram shows their respective eutectic at 486° C. and a melt of the lowest melting point having the melting temperature of about 500° C., respectively. Both the sections have a wide range of melts below 700° C. All these melts are suitable electrolytes. As has been described before in the case of $CaCl_2$-containing melts, these melts provide electrolytes consisting of only LiCl, LiF, and $MgF_2$ without $MgCl_2$ to eliminate its problems and also electrolytes consisting of only LiCl, LiF, and $MgF_2$ which may be found useful to produce magnesium alloys at the bottom of the electrolytes.

The electrolyte consisting of LiCl, LiF, $MgF_2$, and $CaF_2$ melts; $CaCl_2$, $CaF_2$, and $MgF_2$ melts; and $CaCl_2$, $MgCl_2$, and $MgF_2$ melts can be used in the conventional electrolytic magnesium production cell without significant modification. These electrolytes can solve the problems posed by MgO, allowing the use of inexpensive $MgCl_2$ feed.

Electrolytes for Aluminum Production Type Cell

Lithium chloride is lighter than magnesium metal at temperatures near 1000 K. (723° C.). The LiCl—LiF—$MgF_2$ ternary shows all the ternary compositions containing LiCl above 30 mole % to be molten below 700° C. All these melts can be used as electrolytes for the magnesium production process. The densities of some of these melts are given below.

TABLE I

Prospective Electrolytes

| Melt Composition, w/o | | | Density, g/cc at T = | |
|---|---|---|---|---|
| LiCl | LiF | $MgF_2$ | 1000 K | 1050 K |
| 85 | 5 | 10 | 1.540 | 1.518 |
| 85 | 10 | 5 | 1.521 | 1.4984 |
| 90 | — | 10 | 1.522 | 1.500 |
| 95 | — | 5 | 1.486 | 1.464 |
| 50 | 25 | 25 | 1.753 | 1.732 |
| 55 | 35 | 10 | 1.781 | 1.757 |

The first four melts given in the Table can be used as electrolytes for producing magnesium or its alloys such as Mg—Al, Mg—Cu—Zn, etc., at the bottom like aluminum is produced at the bottom of cryolite. All these electrolytes have densities lower than magnesium metal. The other two electrolytes shown at the bottom of the table, for example, can be used in the conventional magnesium production cell if desired to produce a magnesium pool which floats but which is mostly submerged in the electrolyte.

The first four melts should behave like those of LiCl—LiF—$MgF_2$—$CaF_2$ melts during electrolysis. In developing the process, all the knowledge and technology gained in developing the aluminum production process can be used. A melt consisting of 85 w/o LiCl-10 w/o $MgF_2$-5 w/o LiF has been used and found suitable as an electrolyte for using $MgCl_2$ feed containing about 1 w/o MgO. The electrolysis was successfully carried out for about four hours with the above feed.

The presence of neodymium fluoride ($NdF_3$) or other rare earth fluoride in the fluoride electrolyte melt increases the solubility of magnesium oxide in these melts. This happens because MgO reacts with $NdF_3$ forming NdOF by the reaction $$MgO+MdF_3 \rightarrow MgF_2+NdOF \quad (11)$$

This reaction is spontaneous as is indicated by its negative standard free energy change. This reaction and the solubility of product NdOF in $MgF_2$—$NdF_3$ melts have been experimentally observed. Neodymium fluoride can be added to the above-mentioned ternary $MgF_2$—$CaF_2$—LiF eutectic melt electrolyte to increase its magnesium oxide solubility. Thermochemical data indicates that $NdF_3$ is less likely to react with $MgCl_2$ than $CaF_2$ or LiF. In extreme cases, an electrolyte composition consisting of $NdF_3$, $CaF_2$, $MgF_2$, and LiF may be determined where a feedstock of MgO may be used.

Advantages

The electrolytes of the present invention may solve the problem caused by solid magnesium oxide in the electrolyte in the existing conventional cells. Herein MgO reacts with electrolytically-generated magnesium droplets on their surface to form magnesium suboxide ($Mg_2O$). This suboxide on the surface prevents the droplets from coalescing. The presence of these droplets in the electrolyte may allow them to react with the electrolytically-generated chlorine, producing magnesium chloride and thus causing low magnesium production efficiency. The present fluoride electrolyte dissolves magnesium oxide which then electrolytically decomposes. Therefore, the above problem should not be encountered.

The absence of magnesium chloride in the electrolyte is an advantage. Magnesium chloride feed is always reported to contain a small amount of magnesium hydroxychloride (MgOHCl). This is reported to exist in the electrolyte possibly as $Mg(OH)^+$ and $Cl^-$ ions. The $Mg(OH)^+$ ions may be discharged as MgO and $H_2$ at the cathode. The MgO presence on the cathode may decrease the effective cathode surface area for magnesium deposition and thus may lead to inefficient cell operation. The hydrogen and electrolytically generated chlorine may react with MgO in the electrolyte to re-form magnesium hydroxychloride. In this way a shuttle reaction may occur and cause low coulombic efficiency. The present fluoride electrolyte reacts with magnesium chloride feed to form lithium chloride or calcium chloride and magnesium fluoride. The removal of magnesium chloride in the electrolyte will lead to the destruction of magnesium hydroxychloride in the electrolyte and therefore eliminates the above problem.

Two new types of alloys may be useful for the automobile industry in the future: magnesium-calcium alloys and magnesium-lithium alloys. These alloys may be produced inexpensively using the proposed electrolytes.

The present electrolyte is a mixture of chlorides and fluorides. Alumina refractory components of the cell are stable with the chloride-based electrolytes, but they may not be stable with only fluoride-based electrolytes. Therefore, an electrolyte consisting of a mixture of the chlorides and fluorides may be found which dissolves the magnesium oxide content of the magnesium chloride feed and does not attack alumina components of the cell at the same time.

An electrolyte consisting of $CaCl_2$, $CaF_2$, and $MgF_2$ is suitable to use in this process. These are the most commonly available and inexpensive materials one can use in the electrolyte.

Experimental Results

To test the feasibility of using the mixed chloride-fluoride electrolytes in a conventional-type laboratory magnesium production cell, three experiments have been carried out. In this type of cell, the magnesium produced floats on top of the electrolyte. The conditions and results are briefly described below:

| Experiment #1 - Electrolyte composition | | |
|---|---|---|
| LiF | 28.56 | wt. % |
| $MgF_2$ | 32.40 | wt. % |
| $CaF_2$ | 19.04 | wt. % |
| $MgCl_2$ | 20.00 | wt. % |
| Temperature | ~750° C. | |
| Anode area | ~5 | $cm^2$ |
| Current density | 500–800 | $ma/cm^2$ |
| Duration (Includes holding period) | ~50 | hr |
| Mg produced | ~13.5 | g |
| Coulombic efficiency | ~55% | |
| **Experiment #2 - Electrolyte composition** | | |
| LiCl | 19.02 | wt. % |
| LiF | 29.65 | wt. % |
| $MgF_2$ | 51.33 | wt. % |
| Total | 740 | g |
| Temperature | ~750° C. | |

-continued

| | | |
|---|---|---|
| Anode area | ~5 | $cm^2$ |
| Current density | 800–1000 | $ma/cm^2$ |
| Duration (Includes holding period) | ~170 | hr |
| Mg produced | ~49 | g |
| Coulombic efficiency | ~98% | |
| **Experiment #3 - Electrolyte composition** | | |
| $CaCl_2$ | 79.97 | wt. % |
| $CaF_2$ | 10.88 | wt. % |
| $MgF_2$ | 9.15 | wt. % |
| Total | 951 | g |
| Temperature | ~750° C. | |
| Anode area | ~5 | $cm^2$ |
| Current density | ~800 | $ma/cm^2$ |
| Duration (No holding period) | ~11 | hr |
| Mg produced | ~18 | g |
| Coulombic efficiency | ~89% | |

Good separation between magnesium metal and the electrolyte was observed. No problem was observed collecting the magnesium metal in the pool. Magnesium metal produced was of good quality and free from salt inclusions.

While this invention has been described in terms of certain preferred embodiments thereof, it will be appreciated that other forms could readily be adapted by one skilled in the art. Accordingly, the scope of this invention is to be considered limited only by the following claims.

What is claimed is:

1. A method of producing magnesium metal using a feedstock comprising a material selected from the group consisting of magnesium chloride, magnesium oxide and mixtures of magnesium chloride and magnesium oxide, said method comprising adding said feedstock to an electrolytic cell comprising a molten salt electrolyte, an anode and a cathode immersed in said electrolyte, said electrolyte consisting essentially of magnesium cations and lithium and/or calcium cations and chloride and fluoride anions, the composition of said anions and cations corresponding to a molten salt mixture of magnesium fluoride and at least two salts selected from the group consisting of LiF, LiCl, $CaF_2$ and $CaCl_2$; and applying a direct current potential to said anode and cathode.

2. A method as recited in claim 1 in which the density of the electrolyte is higher than the density of the magnesium produced, and the magnesium is confined in a compartment adjacent said cathode.

3. A method as recited in claim 1 in which the density of the electrolyte is lower than the density of the magnesium produced, and the magnesium is thus produced at a cathode below the molten electrolyte.

4. A method of producing magnesium metal using a feedstock comprising a material selected from the group consisting of magnesium chloride, magnesium oxide and mixtures of magnesium chloride and magnesium oxide, said method comprising adding said feedstock to an electrolytic cell comprising a molten salt electrolyte, an anode and a cathode immersed in said electrolyte, said electrolyte consisting essentially of magnesium cations and lithium and/or calcium cations and chloride and fluoride anions, the composition of said anions and said cations corresponding substantially to a molten salt mixture selected from the group consisting of (a) $MgF_2$, LiF, LiCl; (b) $MgF_2$, $CaF_2$, $CaCl_2$; (c) $MgF_2$, $CaF_2$, LiF; (d) $MgF_2$, $CaF_2$, LiF, LiCl; (e) $MgF_2$, $CaF_2$, $CaCl_2$, LiF; and applying a direct current potential to said anode and cathode.

* * * * *